US011480310B2

(12) United States Patent
Tanaka

(10) Patent No.: US 11,480,310 B2
(45) Date of Patent: Oct. 25, 2022

(54) VEHICULAR LAMP BODY

(71) Applicant: Honda Motor Co., Ltd., Tokyo (JP)

(72) Inventor: Yoshiro Tanaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/463,515

(22) Filed: Aug. 31, 2021

(65) Prior Publication Data

US 2022/0107072 A1 Apr. 7, 2022

(30) Foreign Application Priority Data

Oct. 1, 2020 (JP) ..... JP2020-166974

(51) Int. Cl.

| | |
|---|---|
| ***F21S 41/675*** | (2018.01) |
| ***F21S 41/25*** | (2018.01) |
| ***F21S 41/39*** | (2018.01) |
| ***F21S 41/32*** | (2018.01) |
| *F21W 103/55* | (2018.01) |

(52) U.S. Cl.

CPC ..... *F21S 41/675* (2018.01); *F21S 41/25* (2018.01); *F21S 41/32* (2018.01); *F21S 41/39* (2018.01); *F21W 2103/55* (2018.01)

(58) Field of Classification Search

None

See application file for complete search history.

(56) References Cited

U.S. PATENT DOCUMENTS

| | | | | |
|---|---|---|---|---|
| 2004/0257790 | A1* | 12/2004 | Tanaka | B60Q 1/26 362/23.07 |
| 2005/0117236 | A1* | 6/2005 | Tanaka | B60R 1/1207 359/876 |
| 2014/0003075 | A1* | 1/2014 | Yamada | F21S 43/20 362/511 |
| 2014/0140081 | A1* | 5/2014 | Takahashi | G02B 6/001 362/509 |
| 2015/0321599 | A1* | 11/2015 | Yamada | F21S 43/241 362/511 |
| 2016/0053962 | A1* | 2/2016 | Akutsu | F21S 43/241 362/511 |
| 2016/0207446 | A1* | 7/2016 | Egawa | B60Q 1/0035 |
| 2016/0273728 | A1* | 9/2016 | Izawa | B60Q 1/0041 |
| 2018/0029529 | A1* | 2/2018 | Iseki | F21S 43/245 |
| 2018/0112847 | A1* | 4/2018 | Childress | F21S 43/14 |

FOREIGN PATENT DOCUMENTS

| | | |
|---|---|---|
| JP | 2019050132 | 3/2019 |

* cited by examiner

*Primary Examiner* — Elmito Breval

(74) *Attorney, Agent, or Firm* — JCIPRNET

(57) ABSTRACT

A vehicular lamp body includes a light source which is mounted in a vehicle, an outer lens which guides light from the light source and emits the light, and a housing which holds the outer lens. The outer lens has a lens part which is exposed on an outer surface of the vehicle and guides light from the light source and emits the light to the outside; and a reflection part which is integrally formed with the lens part, reflects light from the light source, and guides the light to the lens part. A light diffusion part is formed on an inner surface of the lens part.

4 Claims, 9 Drawing Sheets

VEHICULAR LAMP BODY

CROSS-REFERENCE TO RELATED APPLICATION

This application claims the priority benefits of Japanese application no. 2020-166974, filed on Oct. 1, 2020. The entirety of the above-mentioned patent application is hereby incorporated by reference herein and made a part of this specification.

BACKGROUND

Technical Field

The disclosure relates to a vehicular lamp body.

Description of Related Art

In the related art, regarding vehicular lamp bodies mounted in a vehicle, a structure, in which a light source and a light guide member causing light emitted from the light source to be incident on the inside through an incident surface on one end side and guiding the light toward an emission surface on the other end side while repeating reflection inside thereof are combined, is known. In these vehicular lamp bodies, generally, it is difficult to perform positioning of an outer lens with respect to the light source. For this reason, as illustrated in FIG. 9, various technologies for causing an inner lens 120 to emit light and emitting the light to the outside through an outer lens 110 by employing a structure in which light is guided by the inner lens 120 provided on an inner side of the outer lens 110 have been proposed.

For example, Patent Document 1 discloses a constitution of a clearance lamp having a light source, an inner lens which guides light from the light source, a housing which surrounds the inner lens, and an inner lens cover (outer lens). The inner lens has a first light guide part that includes an incident part in which light emitted from the light source is incident on the inside thereof; and a second light guide part that includes a first reflection surface which reflects light incident from the incident part, a second reflection surface which reflects light reflected by the first reflection surface, and an emission surface which emits light reflected by the second reflection surface to the outside. According to the technology described in Patent Document 1, since the inner lens includes a light diffusion part which diffuses at least a part of light incident on any surface of the first reflection surface, the second reflection surface, and the emission surface, the inner lens can emit light while light is diffused by the inner lens.

PATENT DOCUMENTS

[Patent Document 1] Japanese Patent Laid-Open No. 2019-50132

However, as in the technology described in Patent Document 1 and the technology in the related art in FIG. 9, in a structure in which a light emission structure is provided in an inner lens disposed on an inner side of an outer lens, inner lenses serving as a plurality of light guide members are disposed inside the outer lens. Therefore, there is concern that the number of components may increase. In addition, since there is a need to dispose light guide members inside a closed space surrounded by the outer lens and a housing, the degree of freedom in design deteriorates, and therefore there is concern that it may be difficult to ensure a sufficient light emission area in a vehicular lamp body.

SUMMARY

The disclosure provides a vehicular lamp body in which the degree of freedom in design can be improved and a light emission area having a sufficient size can be ensured while the number of components is reduced.

In order to resolve the foregoing problems, a vehicular lamp body according to the disclosure described in claim 1 (for example, a vehicular lamp body 1 according to a first embodiment) includes a light source (for example, a light source 2 according to the first embodiment) which is mounted in a vehicle, an outer lens (for example, an outer lens 3 according to the first embodiment) which guides light from the light source and emits the light, and a housing (for example, a housing 4 according to the first embodiment) which holds the outer lens. The outer lens has a lens part (for example, a lens part 14 according to the first embodiment) which is exposed on an outer surface of the vehicle, guides light from the light source, and emits the light to the outside; and a reflection part (for example, a reflection part 13 according to the first embodiment) which is integrally formed with the lens part, reflects light from the light source, and guides the light to the lens part. A light diffusion part (for example, a light diffusion part 10 according to the first embodiment) is formed on an inner surface (for example, an inner surface 14*a* according to the first embodiment) of the lens part.

In addition, in the vehicular lamp body according to the disclosure described in claim 2, the housing has a first seal part (for example, a first seal part 23 according to the first embodiment) which seals a space between the housing and the outer lens.

In addition, the vehicular lamp body according to the disclosure described in claim 3 further includes a light source cover (for example, a light source cover 5 according to the first embodiment) which holds the light source. The light source cover has a second seal part (for example, a second seal part 32 according to the first embodiment) which seals a space between the light source cover and the outer lens.

In addition, in the vehicular lamp body according to the disclosure described in claim 4, a closed cross section (for example, a closed cross section 29 according to the first embodiment) is formed by the outer lens and the housing. The light source is disposed outside the closed cross section.

A vehicular lamp body according to the disclosure described in claim 5 (for example, a vehicular lamp body 801 according to an eighth embodiment) includes a light source (for example, a light source 802 according to the eighth embodiment) which is mounted in a vehicle, a daytime running lamp lens for a daytime running lamp (for example, a daytime running lamp lens 803 according to the eighth embodiment) which guides light from the light source and emits the light, a movable mirror (for example, a movable mirror 806 according to the eighth embodiment) which is provided between the light source and the daytime running lamp lens, a control unit (for example, a control unit 807 according to the eighth embodiment) which controls operation of the movable mirror, and a headlamp lens (for example, the headlamp lens 808 according to the eighth embodiment) which guides light from the light source to irradiate a side in front of the vehicle and is different from the daytime running lamp lens. The daytime running lamp lens has a lens part (for example, a lens part 14 according to the eighth embodiment) which is exposed on an outer surface of the vehicle, guides light from the light source, and emits the light to the outside; a reflection part (for example, a reflection part 13 according to the eighth embodiment) which is integrally provided with the lens part, reflects light from the light source, and guides the light to the lens part; and a light guide part (for example, a light guide part 11 according to the eighth embodiment) which guides light from the light source and guides the light to the reflection part. The control unit switches the movable mirror in accordance with an external environment of the vehicle between a first state (for example, a first state ST1 according to the eighth embodiment) in which light from the light source is reflected toward the light guide part of the daytime running lamp lens and a second state (for example, a second state ST2 according to the eighth embodiment) in which light from the light source is reflected toward the headlamp lens.

In the vehicular lamp body according to the disclosure described in claim 6, the control unit switches the movable mirror to the first state when the external environment has a brightness equal to or higher than a predetermined brightness and switches the movable mirror to the second state when the external environment has a brightness lower than the predetermined brightness.

According to the vehicular lamp body described in claim 1 of the disclosure, the outer lens emits light by causing the outer lens to guide light from the light source. Accordingly, since there is no need to provide an inner lens as a light guide member, compared to a technology in the related art having both an inner lens and an outer lens, the number of components can be reduced. The outer lens has the lens part which guides light from the light source and emits the light to the outside, and the reflection part which reflects light from the light source and guides the light to the lens part. Since the lens part and the reflection part are integrally formed, light can be guided and emitted by one outer lens. Thus, increase in the number of components can be better curbed. In addition, the light diffusion part is formed on the inner surface of the lens part. Accordingly, light guided to the lens part is emitted from the lens part while being diffused by the light diffusion part, and the outer lens emits light. Thus, efficiency of utilization of light can be enhanced and light can be brightly emitted over an extensive range.

Moreover, since there is no need to provide an inner lens, an extensive space on the inner side of the outer lens can be ensured. Accordingly, for example, the outer lens can be equipped with various functions by disposing other components in a space on the inner side of the outer lens, or the like. In addition, for example, the size of a light emission area in the outer lens can be easily changed by changing the area of the light diffusion part formed in the outer lens. Accordingly, compared to a technology in the related art in which the light emission area is restricted depending on the size of the inner lens, the size of the light emission area in the outer lens can be set to a desired size. Thus, while the degree of freedom in design is improved, a light emission area larger than that of a technology in the related art can be obtained.

Therefore, it is possible to provide a vehicular lamp body in which the degree of freedom in design can be improved and a light emission area having a sufficient size can be ensured while the number of components is reduced.

According to the vehicular lamp body described in claim 2 of the disclosure, the housing has the first seal part which seals a space between the housing and the outer lens. Accordingly, the housing for holding the outer lens can also have a function of sealing a space between the housing and the outer lens. Thus, compared to when a seal member is separately provided between the housing and the outer lens, the number of components can be reduced.

According to the vehicular lamp body described in claim 3 of the disclosure, the light source cover has the second seal part which seals a space between the light source cover and the outer lens. Accordingly, the light source cover for holding the light source can also have a function of sealing a space between the light source cover and the outer lens. Thus, compared to when a seal member is separately provided between the light source cover and the outer lens, the number of components can be reduced. In addition, since the light source can be reliably fixed to the outer lens serving as a light guide member, light emission defects or deterioration in brightness due to misalignment of the light source can be curbed. Therefore, the brightness can be ensured as designed, and a vehicular lamp body allowing improved visibility can be achieved.

According to the vehicular lamp body described in claim 4 of the disclosure, the closed cross section is formed by the outer lens and the housing. The light source is disposed outside the closed cross section. Accordingly, compared to when the light source is disposed inside the narrow closed cross section, the sizes and the shapes of the light source, the reflection part of the outer lens, and the like can be designed with a relatively high degree of freedom. Thus, the degree of freedom in design of the vehicular lamp body can be improved. In addition, since light can enter the outer lens from the outside, the vehicular lamp body can also be applied to a case in which one light source installed outside the closed cross section is shared, for example, by a plurality of lenses, or the like. Thus, versatility of the vehicular lamp body can be improved.

According to the vehicular lamp body described in claim 5 of the disclosure, the daytime running lamp lens includes the lens part, the reflection part, and the light guide part. Light from the light source reaches the reflection part through the light guide part, is reflected by the reflection part, and then reaches the lens part. Light guided to the lens part is emitted to the outside from the lens part. In this manner, the daytime running lamp lens emits light by causing the daytime running lamp lens to guide light from the light source. Accordingly, since there is no need to provide an inner lens inside the daytime running lamp lens, compared to a technology in the related art in which an inner lens is separately provided as a light guide member inside the daytime running lamp lens, the number of components can be reduced. In addition, since the lens part and the reflection part are integrally formed, increase in the number of components can be better curbed.

Since there is no need to provide an inner lens, an extensive space on the inner side of the daytime running lamp lens can be ensured. Accordingly, for example, the daytime running lamp lens can be equipped with various functions by disposing other components in a space on the inner side of the daytime running lamp lens, or the like. In addition, since the daytime running lamp lens exposed on the outer surface of the vehicle can serve as a light emission surface, compared to when an inner lens serves as the light emission surface, the size of the light emission surface can be increased. Thus, while the degree of freedom in design is improved, a light emission area larger than that of a technology in the related art can be obtained.

Moreover, the vehicular lamp body includes the movable mirror which is provided between the light source and the daytime running lamp lens, the control unit which controls operation of the movable mirror, and the headlamp lens. The control unit switches the movable mirror between the first state in which light from the light source is reflected toward the light guide part of the daytime running lamp lens and the second state in which light from the light source is reflected toward the headlamp lens. In the first state, the daytime running lamp comes on when light from the light source is incident on the daytime running lamp lens and the daytime running lamp lens emits light. On the other hand, in the second state, the headlight comes on, for example, when light from the light source is emitted toward the headlamp lens. The daytime running lamp is used mainly during the daytime, and the headlight is used mainly at night. For this reason, one light source can be used as both a light source for a daytime running lamp and a light source for a headlight by switching the movable mirror in accordance with the external environment of the vehicle. Accordingly, the light source can be efficiently utilized, and the number of components can be reduced compared to when a light source is individually provided for each of the lights. Particularly, since a bright light source for a headlight can be used, a sufficient brightness can be ensured even if the light source is shared. In addition, due to a structure in which light from the light source is guided and emitted by the daytime running lamp lens, compared to a technology in the related art in which an inner lens is provided as a light guide member on the inner side of the daytime running lamp lens, a constitution using the shared light source described above can be easily realized. Thus, the degree of freedom in design and versatility can be improved.

Therefore, it is possible to provide a vehicular lamp body in which the degree of freedom in design can be improved and a light emission area having a sufficient size can be ensured while the number of components is reduced.

According to the vehicular lamp body described in claim 6 of the disclosure, the control unit switches the movable mirror to the first state when the external environment has a brightness equal to or higher than a predetermined brightness and switches the movable mirror to the second state when the external environment has a brightness lower than the predetermined brightness. In this manner, the movable mirror can be switched to the first state during the daytime, that is, the daytime running lamp can come on by switching the movable mirror in accordance with the brightness outside the vehicle. In addition, the movable mirror can be switched to the second state, that is, the headlight can come on at night. Thus, the kind of a light used automatically switches in accordance with the external environment, and it is possible to achieve a vehicular lamp body which is easy for a driver to use.

DESCRIPTION OF THE EMBODIMENTS

Hereinafter, embodiments of the disclosure will be described with reference to the drawings.

First Embodiment (Vehicular Lamp Body)

Figure 1:
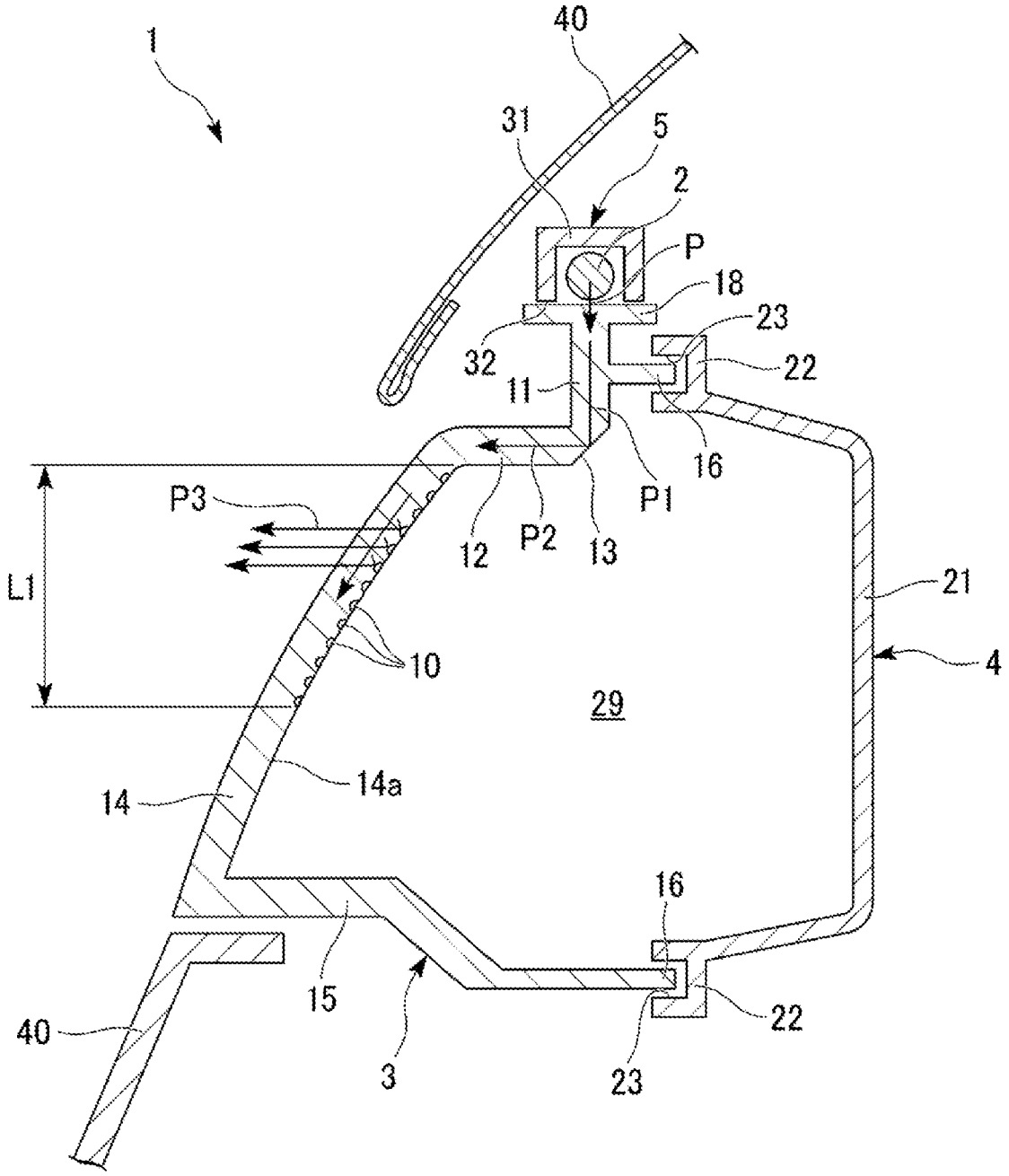
FIG. 1 is a cross-sectional view of a vehicular lamp body according to a first embodiment.

FIG. 1 is a cross-sectional view of a vehicular lamp body 1 according to a first embodiment.

For example, the vehicular lamp body 1 is mounted in a vehicle (not illustrated). For example, the vehicular lamp body 1 is used as a daytime running lamp (DPL) for a vehicle. The daytime running lamp is used such that it comes on mainly during the daytime. A pair of vehicular lamp bodies 1 is provided on the front side of the vehicle and emits light toward the front. In the following description, a forward-rearward direction, a lateral direction, and a vertical direction coincide with a forward-rearward direction, a lateral direction, and a vertical direction in the vehicle. In addition, the lateral direction may be referred to as a vehicle width direction.

The vehicular lamp body 1 includes a light source 2, an outer lens 3, a housing 4, and a light source cover 5.

The light source 2 is mounted in a vehicle. For example, the light source 2 is an LED. In addition to the LED, the light source 2 has a printed board in which the LED is mounted, an electric cable for supplying electricity to the LED, and the like. A plurality of light sources 2 is provided in the vehicle width direction or is formed to have an elongated shape continuously extending in the vehicle width direction. The light source 2 is disposed inside the vehicle such that it is covered by an external member 40 of the vehicle, such as an outer panel and a cowling. The light source 2 emits light P toward a light guide part 11 of the outer lens 3 (which will be described below in detail). In the present embodiment, the light source 2 emits the light P downward.

The outer lens 3 is disposed below the light source 2. The outer lens 3 guides light from the light source 2 and emits the light. For example, the outer lens 3 is formed of a material having a higher refractive index than air, such as a transparent resin including polycarbonate and acryl, or glass. The outer lens 3 extends in the vehicle width direction and is formed to be curved and bent such that it projects to the outside (a side in front) of the vehicle in a cross-sectional view orthogonal to a longitudinal direction (which will hereinafter be simply referred to as a cross-sectional view of the outer lens 3). Specifically, the outer lens 3 has the light guide part 11, a first extension part 12, a reflection part 13, a lens part 14, a second extension part 15, and an attachment part 16. The light guide part 11, the first extension part 12, the reflection part 13, the lens part 14, the second extension part 15, and the attachment part 16 are integrally formed.

The light guide part 11 guides the light P from the light source 2 such that it is guided to the reflection part 13. The light guide part 11 extends in the vertical direction. A plate-shaped light source installation part 18 extending to the outside and the inside (rearward side) of the vehicle from an upper end part of the light guide part 11 is integrally formed at the upper end part of the light guide part 11. A T-shaped part in a cross-sectional view is formed by the light guide part 11 and the light source installation part 18. The light source 2 is disposed on an upper surface of the light source installation part 18. In addition, the attachment part 16 is connected to an intermediate part of the light guide part 11 in the vertical direction. The attachment part 16 is a part for attaching the outer lens 3 to the housing 4. The attachment part 16 protrudes to the inside of the vehicle from the light guide part 11.

The first extension part 12 is connected to a lower end part of the light guide part 11. The first extension part 12 extends to the outside of the vehicle from the lower end part of the light guide part 11.

The reflection part 13 is provided between the light guide part 11 and the first extension part 12. The reflection part 13 is a slant surface formed on a surface facing the inside of the vehicle (an outer circumferential surface side of the bent part) in a corner part between the light guide part 11 and the first extension part 12. The reflection part 13 is inclined to the outside from the inside of the vehicle toward the lower side from the upper side of the vehicle in a cross-sectional view of the outer lens 3. The reflection part 13 reflects the light P from the light source 2 which has been guided by the light guide part 11, causes the light to be incident on the first extension part 12, and guides the light P to the lens part 14.

The lens part 14 is connected to a vehicle outward side end part of the first extension part 12. The lens part 14 extends to the lower side and the outside of the vehicle from the vehicle outward side end part of the first extension part 12. Specifically, the lens part 14 is inclined to the outside of the vehicle from the inside of the vehicle toward the lower side from the upper side in a cross-sectional view of the outer lens 3 and is gently curved such that it projects to the outside of the vehicle. A boundary part between the lens part 14 and the first extension part 12 is connected in a curved shape. Only the lens part 14 of the outer lens 3 is exposed on an outer surface of the vehicle without being covered by the external member 40 of the vehicle. The lens part 14 guides light from the light source 2 which has been incident from the upper end part toward the lower end part.

A light diffusion part 10 is formed in the lens part 14. The light diffusion part 10 is formed on an inner surface 14*a* of the lens part 14 facing the inside of the vehicle. For example, the light diffusion part 10 is a lens cut. A lens cut is formed by vertically forming a plurality of grooves extending in the vehicle width direction. In the present embodiment, the light diffusion part 10 is formed within a range of a length L1 in the vertical direction from an upper end part of the lens part 14 when viewed from the front. The position and the length at which the light diffusion part 10 is provided can be set within an arbitrary range with respect to the lens part 14 in its entirety. The light diffusion part 10 diffuses the light P from the light source 2 guided by the lens part 14 and emits the light P to the outside (a side in front in the present embodiment) of the vehicle.

The second extension part 15 is connected to the lower end part of the lens part 14. The second extension part 15 extends toward the inside of the vehicle from the lower end part of the lens part 14. A vehicle inward side end part of the second extension part 15 serves as the attachment part 16 of the outer lens 3.

The housing 4 is provided on an inner side of the vehicle than the outer lens 3. The housing 4 holds the outer lens 3. The housing 4 has a housing main body part 21, a holding part 22, and a first seal part 23. The housing main body part 21 is fixed to a frame member or the like (not illustrated) provided inside the vehicle. The housing main body part 21 extends in the vehicle width direction and is formed to have a U-shaped cross section projecting to the inside of the vehicle.

The holding part 22 is individually provided in the upper end part and the lower end part of the housing main body part 21. Each of the holding parts 22 is individually formed to have a U-shape opening to the outer lens 3 side in a cross-sectional view orthogonal to the longitudinal direction of the housing 4. The attachment part 16 of the outer lens 3 is individually fitted to each of the holding parts 22. Specifically, the attachment part 16 protruding from the light guide part 11 of the outer lens 3 is fitted to the holding part 22 provided in the upper end part of the housing 4. The attachment part 16 provided in the vehicle inward side end part of the second extension part 15 in the outer lens 3 is fitted to the holding part 22 provided in the lower end part of the housing 4. Accordingly, the housing 4 holds the outer lens 3.

The first seal part 23 is individually provided in each of the holding parts 22. The first seal part 23 is provided on a surface of the holding part 22 coming into contact with the outer lens 3. The first seal part 23 seals a space between the housing main body part 21 and the outer lens 3. For example, the first seal part 23 forms a labyrinth-shaped boundary part between the holding part 22 and the outer lens 3 in a state in which the outer lens 3 is fitted to the holding part 22 of the housing 4. Namely, the first seal part 23 ensures sealing properties by forming a labyrinth-shaped boundary part and increasing a contact area between the housing 4 and the outer lens 3.

In a state in which the outer lens 3 is attached to the housing 4, between the housing 4 and the outer lens 3, a closed cross section 29 elongated in the vehicle width direction is formed. The first seal part 23 curbs infiltration of dust or moisture into this closed cross section 29 from the outside. In addition, a state in which the closed cross section 29 is formed, the light source 2 is disposed on an outer side than the closed cross section 29.

The light source cover 5 holds the light source 2. The light source cover 5 has a cover main body part 31 and a second seal part 32. The cover main body part 31 covers an outer circumferential part of the light source 2. The cover main body part 31 is formed to have a U-shaped cross section opening toward the light guide part 11 side of the outer lens 3. The cover main body part 31 is attached to the light source installation part 18 of the outer lens 3 by bonding or fitting. In a state in which the light source cover 5 is attached to the light source installation part 18 of the outer lens 3, the light source 2 is disposed inside a space surrounded by the cover main body part 31 and the light source installation part 18.

The second seal part 32 is provided in an end part of the cover main body part 31 forming an outer circumferential edge of an opening. The second seal part 32 is provided on a surface of the light source cover 5 coming into contact with the outer lens 3. The second seal part 32 seals a space between the light source cover 5 and the outer lens 3. For example, the second seal part 32 ensures sealing properties by being fitted to a projection part protruding upward from the upper surface of the light source installation part 18, a recessed part formed in the light source installation part 18, or the like (none is illustrated) and increasing a contact area between the light source cover 5 and the outer lens 3. The second seal part 32 curbs infiltration of dust or moisture into a space surrounded by the cover main body part 31 and the light source installation part 18.

(Optical Path in the Vehicular Lamp Body)

Next, an optical path in the vehicular lamp body 1 will be described.

First, the light emitted toward the light guide part 11 of the outer lens 3 from the light source 2 passes through the light guide part 11, reaches the reflection part 13, and then is reflected by the reflection part 13 (the arrow P1 in FIG. 1). Light reflected by the reflection part 13 is guided by the first extension part 12 and moves toward the lens part 14 (the arrow P2 in FIG. 1). Moreover, light which has reached the lens part 14 is guided along the lens part 14 and a part thereof is diffused by the light diffusion part 10. When diffused light is emitted to the outside of the vehicle, the outer lens 3 emits light (the arrow P3 in FIG. 1).

(Operation and Effects)

Next, operation and effects of the vehicular lamp body 1 described above will be described.

According to the vehicular lamp body 1 of the first embodiment, the outer lens 3 emits light by causing the outer lens 3 to guide the light P from the light source 2. Accordingly, since there is no need to provide an inner lens as a light guide member, compared to a technology in the related art having both an inner lens and an outer lens 3, the number of components can be reduced. The outer lens 3 has the lens part 14 which guides light from the light source 2 and emits the light to the outside, and the reflection part 13 which reflects light from the light source 2 and guides the light to the lens part 14. Since the lens part 14 and the reflection part 13 are integrally formed, light can be guided and emitted by one outer lens 3. Thus, increase in the number of components can be better curbed. In addition, the light diffusion part 10 is formed on the inner surface 14*a* of the lens part 14. Accordingly, light guided to the lens part 14 is emitted from the lens part 14 while being diffused by the light diffusion part 10, and the outer lens 3 emits light. Thus, efficiency of utilization of light can be enhanced and light can be brightly emitted over an extensive range.

Moreover, since there is no need to provide an inner lens, an extensive space on the inner side of the outer lens 3 can be ensured. Accordingly, for example, the outer lens 3 can be equipped with various functions by disposing other components in a space on the inner side of the outer lens 3, or the like.

Figure 9:
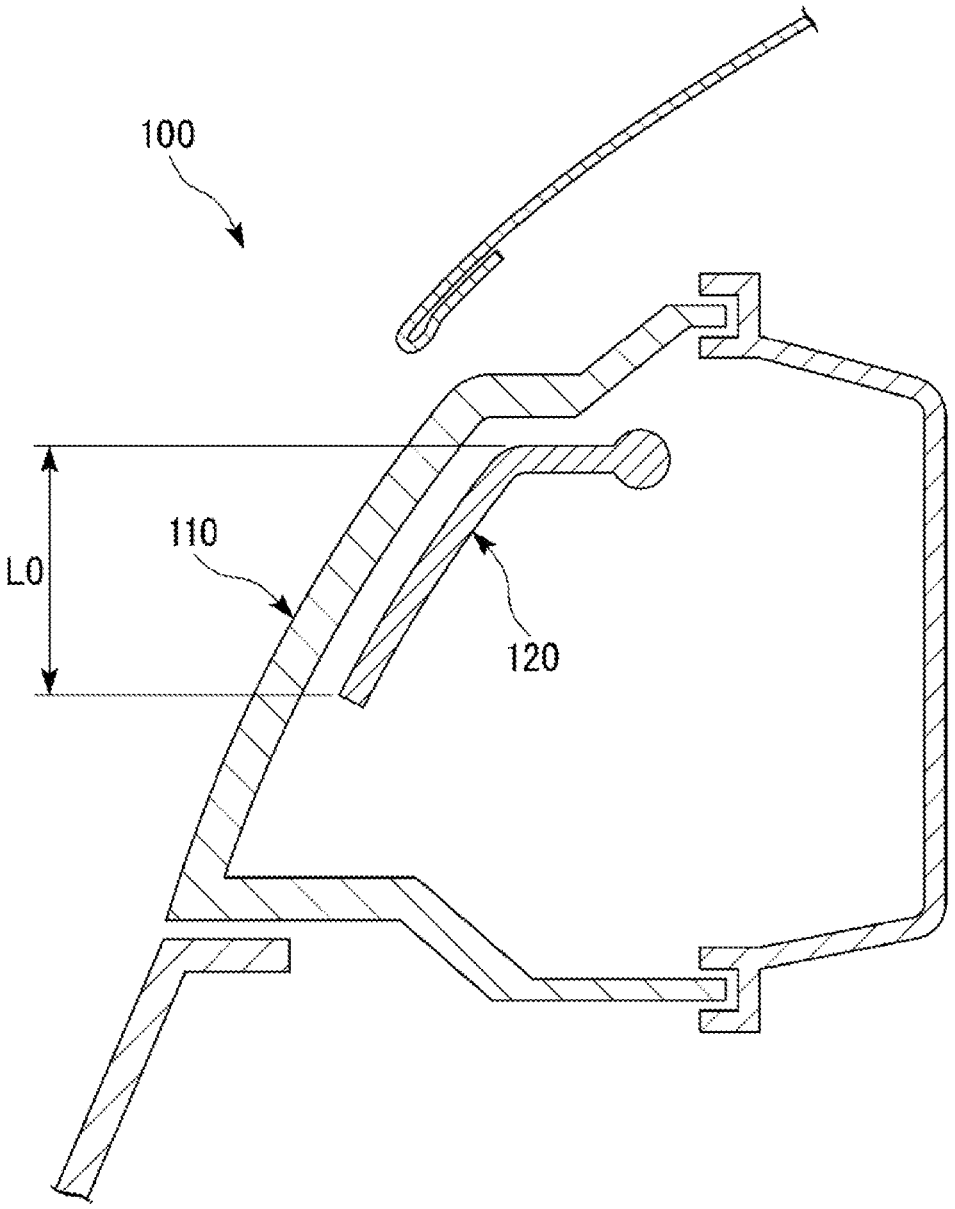
FIG. 9 is a cross-sectional view of a vehicular lamp body according to a technology in the related art.

Here, FIG. 9 is a cross-sectional view of the vehicular lamp body 1 according to a technology in the related art. As illustrated in FIG. 9, in a vehicular lamp body 100 having a constitution in which an inner lens 120 is disposed on the inner side of an outer lens 110 and the inner lens 120 emits light, a light emission area is determined depending on the size of the inner lens 120 (for example, a length L0 of the inner lens in the vertical direction viewed from the front). However, there is a limit to the size of the inner lens 120 accommodated on the inner side of the outer lens 110. For this reason, in a technology in the related art, there is a problem that the size of the inner lens 120 is small with respect to an exposed surface of the outer lens 110 and a light emission area having a sufficient size cannot be obtained.

Regarding this problem, according to the vehicular lamp body 1 of the first embodiment, for example, the size of the light emission area in the outer lens 3 can be easily changed by changing the area of the light diffusion part 10 formed in the outer lens 3 (the length L1 of the light diffusion part 10 in the vertical direction according to the embodiment). Accordingly, compared to a technology in the related art in which the light emission area is restricted depending on the size of the inner lens, the size of the light emission area in the outer lens 3 can be set to a desired size. Thus, while the degree of freedom in design is improved, a light emission area larger than that of a technology in the related art can be obtained.

Therefore, it is possible to provide the vehicular lamp body 1 in which the degree of freedom in design can be improved and a light emission area having a sufficient size can be ensured while the number of components is reduced.

The housing 4 has the first seal part 23 which seals a space between the housing 4 and the outer lens 3. Accordingly, the housing 4 for holding the outer lens 3 can also have a function of sealing a space between the housing 4 and the outer lens 3. Thus, compared to when a seal member is separately provided between the housing 4 and the outer lens 3, the number of components can be reduced.

The light source cover 5 has the second seal part 32 which seals a space between the light source cover 5 and the outer lens 3. Accordingly, the light source cover 5 for holding the light source 2 can also have a function of sealing a space between the light source cover 5 and the outer lens 3. Thus, compared to when a seal member is separately provided between the light source cover 5 and the outer lens 3, the number of components can be reduced. In addition, since the light source 2 can be reliably fixed to the outer lens 3 serving as a light guide member, light emission defects or deterioration in brightness due to misalignment of the light source 2 can be curbed. Therefore, the brightness can be ensured as designed, and the vehicular lamp body 1 allowing improved visibility can be achieved.

The closed cross section 29 is formed by the outer lens 3 and the housing 4. The light source 2 is disposed outside the closed cross section 29. Accordingly, compared to when the light source 2 is disposed inside the narrow closed cross section 29, the sizes and the shapes of the light source 2, the reflection part 13 of the outer lens 3, and the like can be designed with a relatively high degree of freedom. Thus, the degree of freedom in design of the vehicular lamp body 1 can be improved. In addition, since light can enter the outer lens 3 from the outside, the vehicular lamp body 1 can also be applied to a case in which one light source 2 installed outside the closed cross section 29 is shared, for example, by a plurality of lenses, or the like. Thus, versatility of the vehicular lamp body 1 can be improved.

Next, two to eighth embodiments according to the disclosure will be individually described on the basis of FIGS. 2 to 8. In the following description, the same reference signs are applied to constitutions similar to those of the first embodiment described above, and description thereof will be suitably omitted.

Second Embodiment

Figure 2:
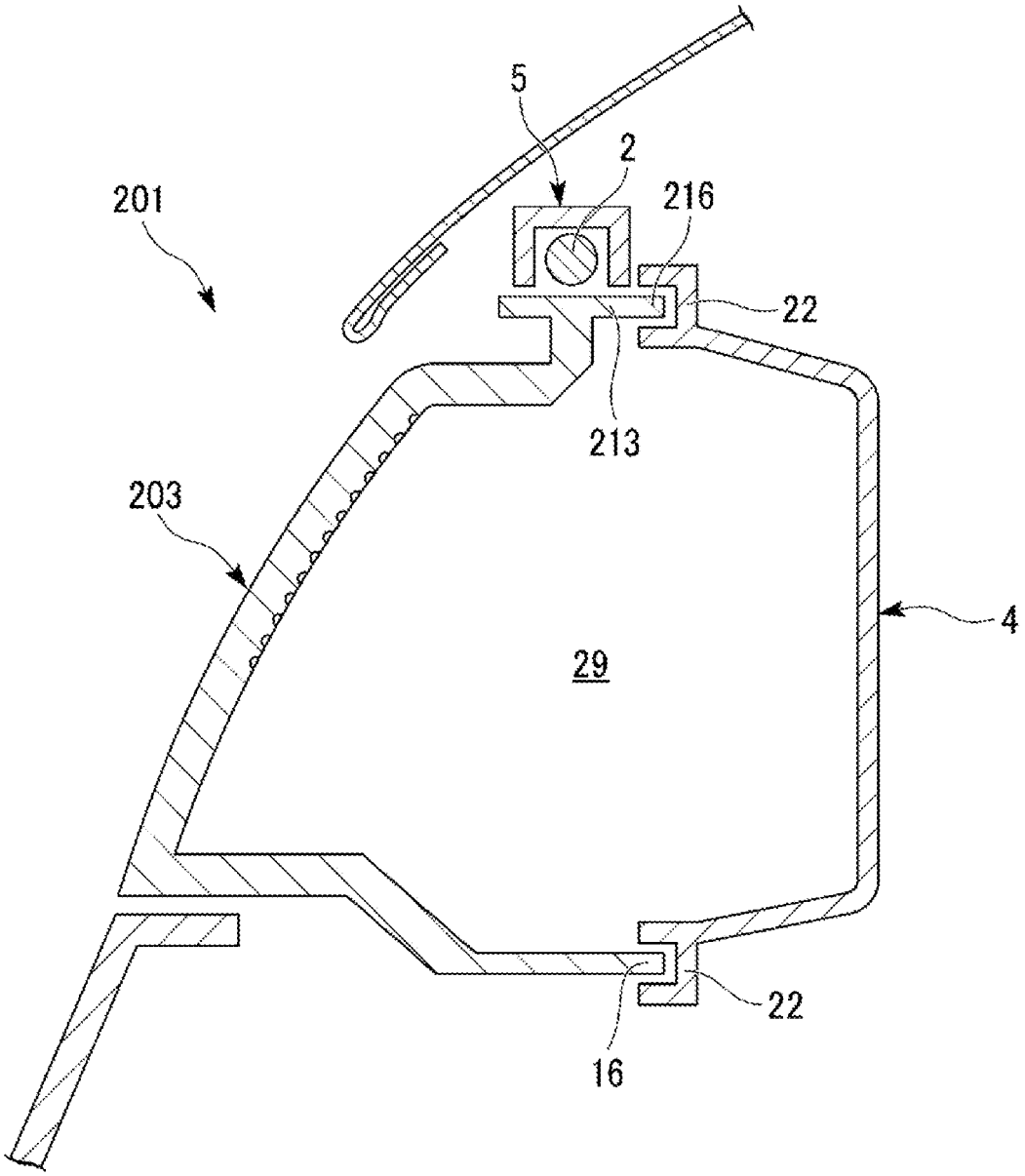
FIG. 2 is a cross-sectional view of a vehicular lamp body according to a second embodiment.

First, the second embodiment according to the disclosure will be described. FIG. 2 is a cross-sectional view of a vehicular lamp body 201 according to the second embodiment. The second embodiment differs from the embodiment described above in that a light source installation part 218 of an outer lens 203 also serves as an attachment part 216.

In the present embodiment, in the light source installation part 218 of the outer lens 203, the length of a part extending to the inside of the vehicle with respect to the light guide part 11 is longer than the length of a part extending to the outside of the vehicle with respect to the light guide part 11. In the light source installation part 218, the vehicle inward side end part in a part extending to the inside of the vehicle from the light guide part 11 serves as the attachment part 216. This attachment part 216 is fitted to the holding part 22 provided in the upper end part of the housing 4.

According to the present embodiment, the constitution of the outer lens 203 can be simplified.

Third Embodiment

Figure 3:
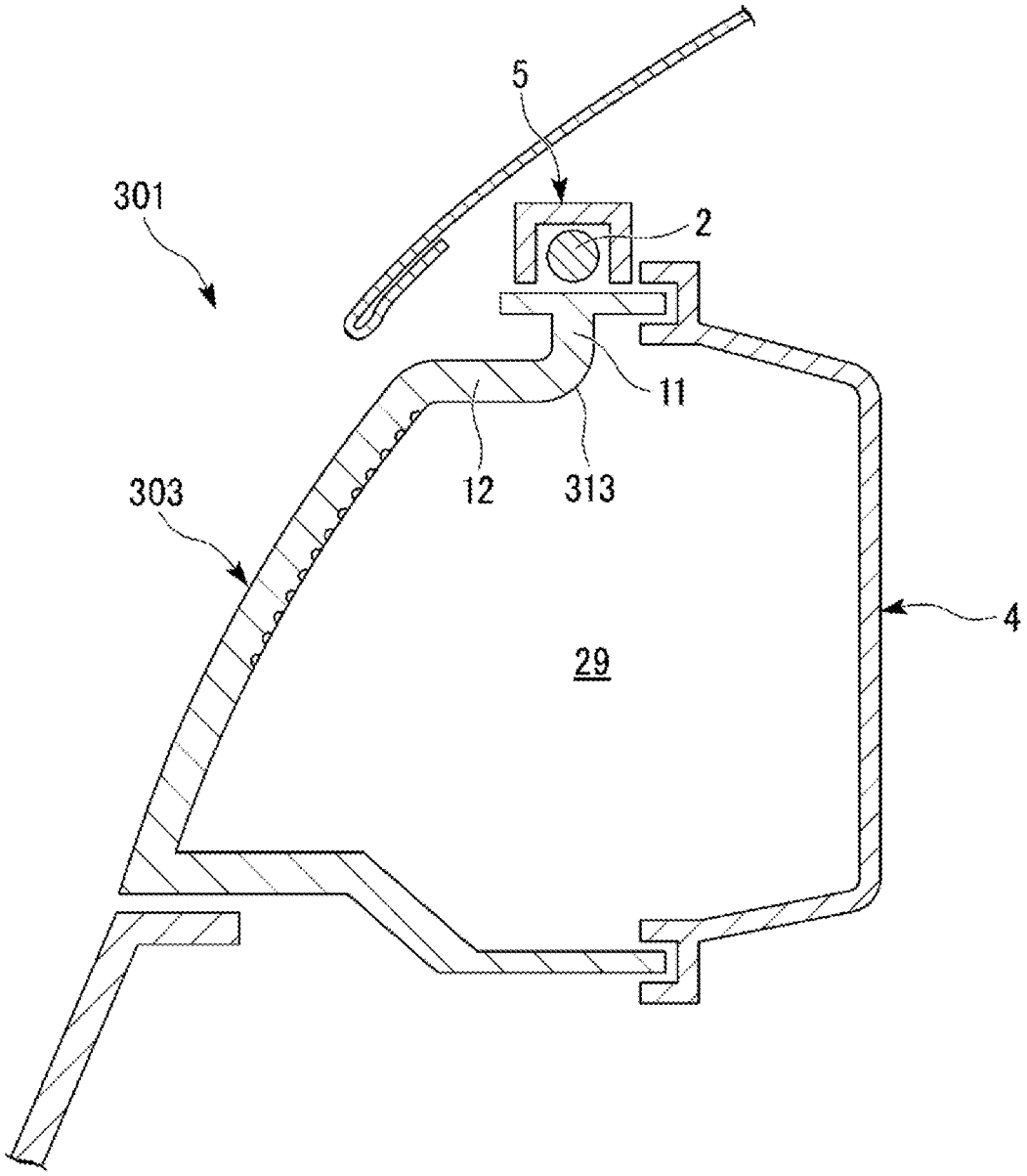
FIG. 3 is a cross-sectional view of a vehicular lamp body according to a third embodiment.

Next, the third embodiment according to the disclosure will be described. FIG. 3 is a cross-sectional view of a vehicular lamp body 301 according to the third embodiment. The third embodiment differs from the embodiments described above in that a reflection part 313 has a curved surface.

In the present embodiment, the light guide part 11 and the first extension part 12 of an outer lens 303 are connected to each other in a continuously curved shape. The reflection part 313 is formed on a surface facing the inside of the vehicle (an outer circumferential surface side of the curved part) in a curve part between the light guide part 11 and the first extension part 12.

According to the present embodiment, even when the reflection part 313 is formed to have a curved shape, operation effects equivalent to those of the first embodiment described above can be exhibited.

Fourth Embodiment

Figure 4:
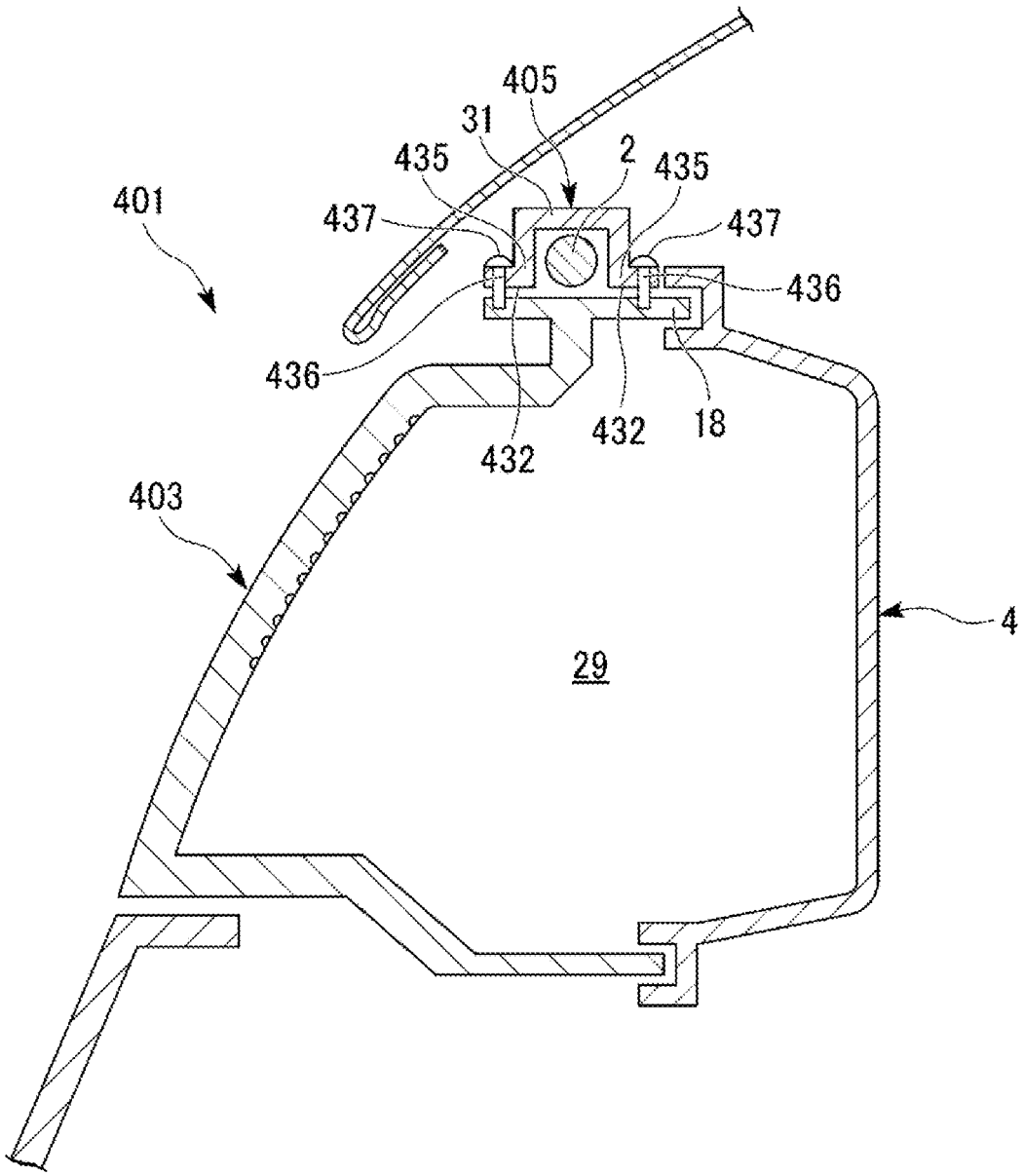
FIG. 4 is a cross-sectional view of a vehicular lamp body according to a fourth embodiment.

Next, the fourth embodiment according to the disclosure will be described. FIG. 4 is a cross-sectional view of a vehicular lamp body 401 according to the fourth embodiment. The fourth embodiment differs from the embodiments described above in a method of fixing a light source cover 405.

In the present embodiment, the light source cover 405 has flanges 435 individually protruding to the inside of the vehicle or the outside of the vehicle from end parts of the U-shaped cover main body part 31. The light source cover 405 is formed to have a hat-shaped cross section due to the cover main body part 31 and the flanges 435. Lower surfaces of the flanges 435 come into contact with the light source installation part 18 of an outer lens 403. A penetration hole 436 lying in the vertical direction is formed in each of the flanges 435. A fastening member 437 such as a screw is inserted into the penetration hole 436. The light source cover 405 is fixed to the outer lens 403 by screwing the fastening member 437 to the light source installation part 18. In the present embodiment, the lower surfaces of the flanges 435 serve as second seal parts 432.

According to the present embodiment, the light source cover 405 can be more reliably fixed to the outer lens 403.

Fifth Embodiment

Figure 5:
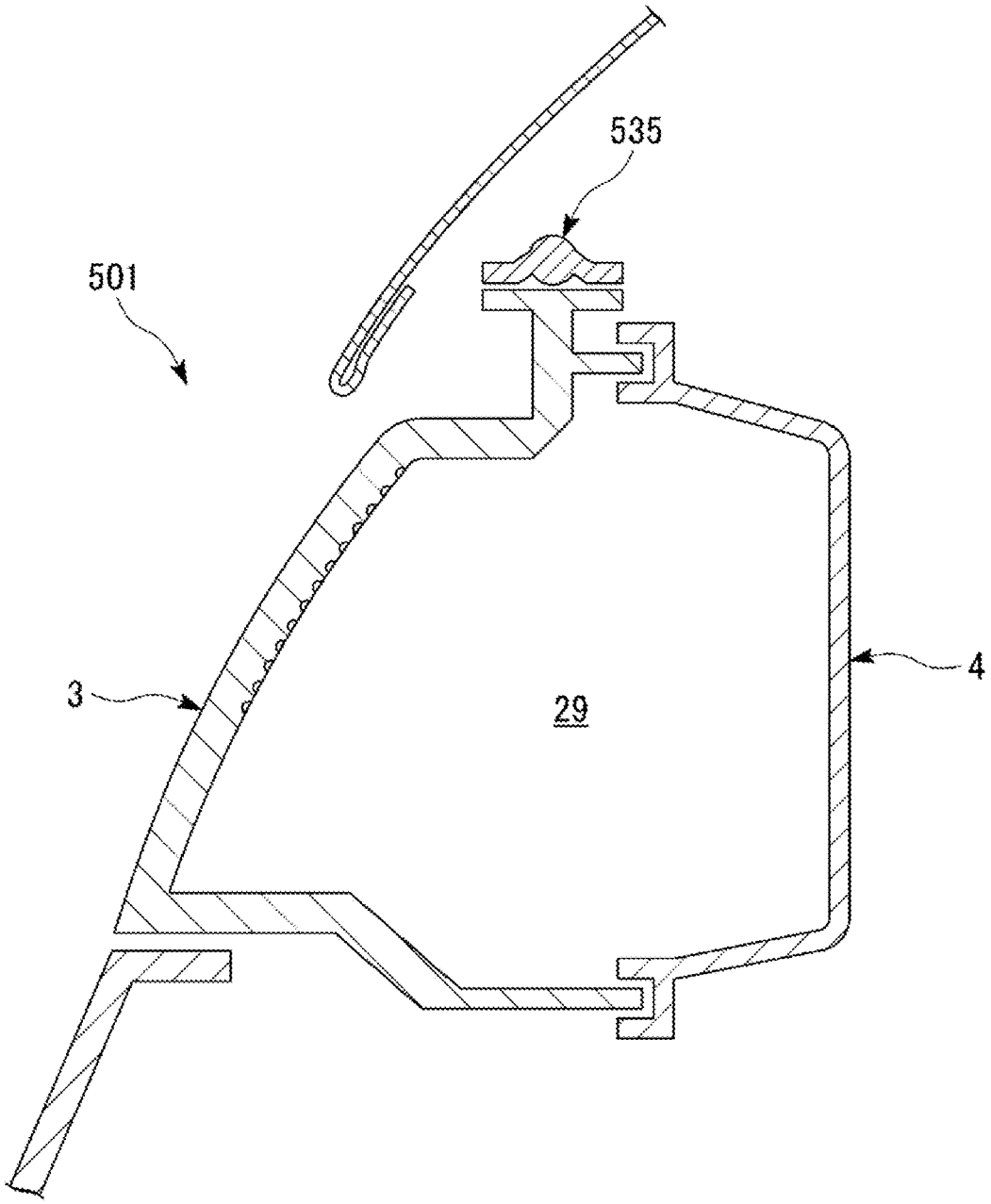
FIG. 5 is a cross-sectional view of a vehicular lamp body according to a fifth embodiment.

Next, the fifth embodiment according to the disclosure will be described. FIG. 5 is a cross-sectional view of a vehicular lamp body 501 according to the fifth embodiment. The fifth embodiment differs from the embodiments described above in using a light source lens 535 in which a light source and a light source cover are integrated.

In the present embodiment, a light entry structure for the outer lens 3 is constituted of only the light source lens 535. The light source lens 535 is installed in the light source installation part 18 of the outer lens 3. The light source lens 535 is fixed to the light source installation part 18 by bonding or fastening, for example. The light source lens 535 emits light to the outer lens 3.

According to the present embodiment, compared to when a light source and a light source cover are provided, the number of components can be reduced. Thus, the constitution of the vehicular lamp body 501 can be further simplified.

Sixth Embodiment

Figure 6:
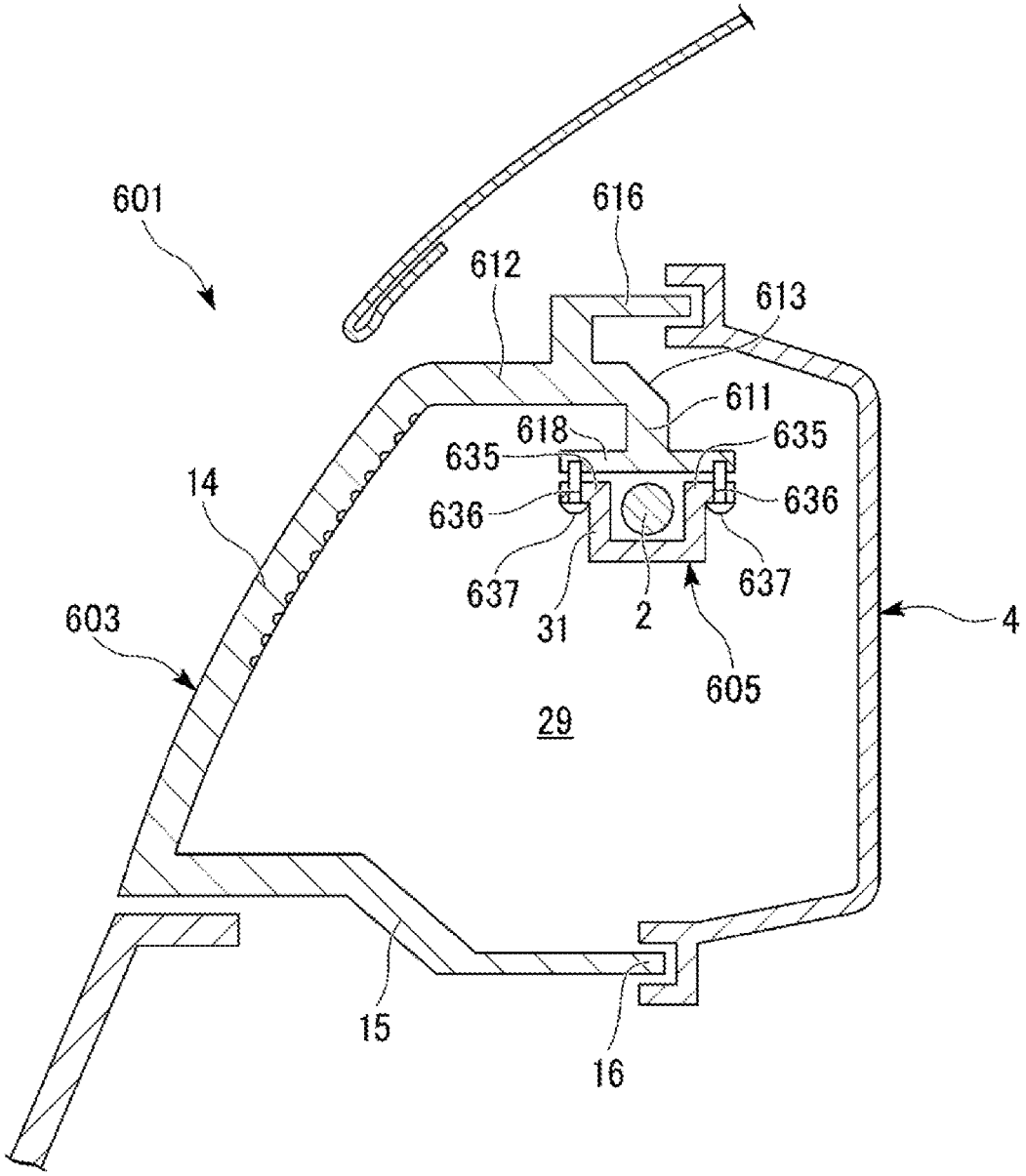
FIG. 6 is a cross-sectional view of a vehicular lamp body according to a sixth embodiment.

Next, the sixth embodiment according to the disclosure will be described. FIG. 6 is a cross-sectional view of a vehicular lamp body 601 according to the sixth embodiment. The sixth embodiment differs from the embodiments described above in that the light source 2 is disposed inside the closed cross section 29 surrounded by an outer lens and a housing.

In the present embodiment, a light guide part 611 of an outer lens 603 extends toward the lower side from a vehicle inward side end part of a first extension part 612, that is, toward the inner side of the closed cross section 29. A light source installation part 618 is provided in the lower end part of the light guide part 611. The light source 2 is disposed on the lower surface of the light source installation part 618. A light source cover 605 covers the light source 2 from below. The light source cover 605 is formed to have a hat-shaped cross section by the U-shaped cover main body part 31 opening upward and flanges 635 individually extending to the inside and the outside of the vehicle from an upper end of the cover main body part 31. A penetration hole 636 is formed in each of the flanges 635. The light source cover 605 is attached to the light source installation part 618 using a fastening member 637 inserted into the penetration hole 636. In addition, an attachment part 616 is connected to the upper surface of the first extension part 612. The attachment part 616 extends upward from the upper surface of the first extension part 612 and then extending toward the inside of the vehicle, thereby being formed to have an L-shaped cross section.

According to the present embodiment, since the light source 2 can be formed inside the closed cross section 29, versatility of the vehicular lamp body 601 can be improved.

Seventh Embodiment

Figure 7:
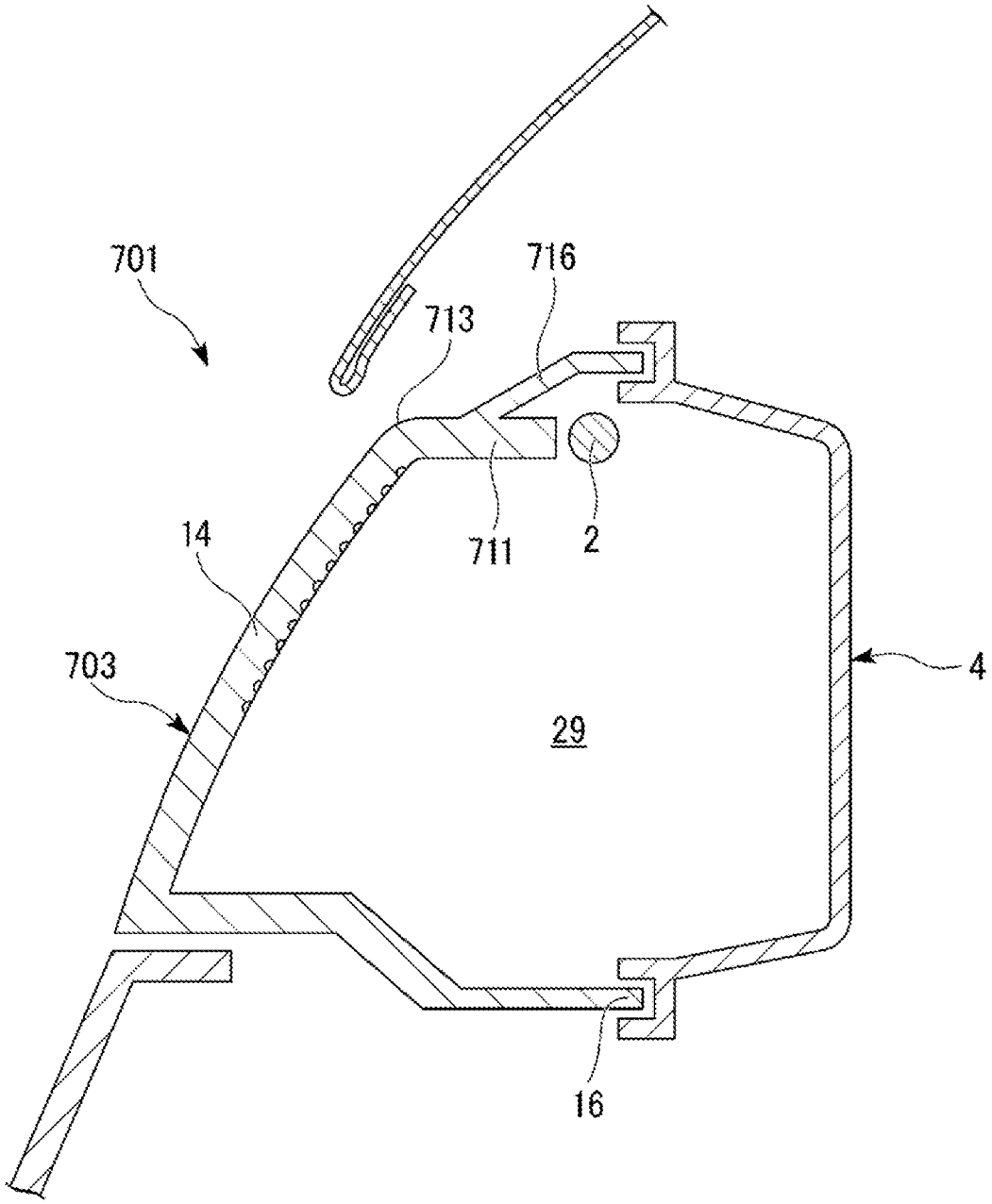
FIG. 7 is a cross-sectional view of a vehicular lamp body according to a seventh embodiment.
Figure 8:
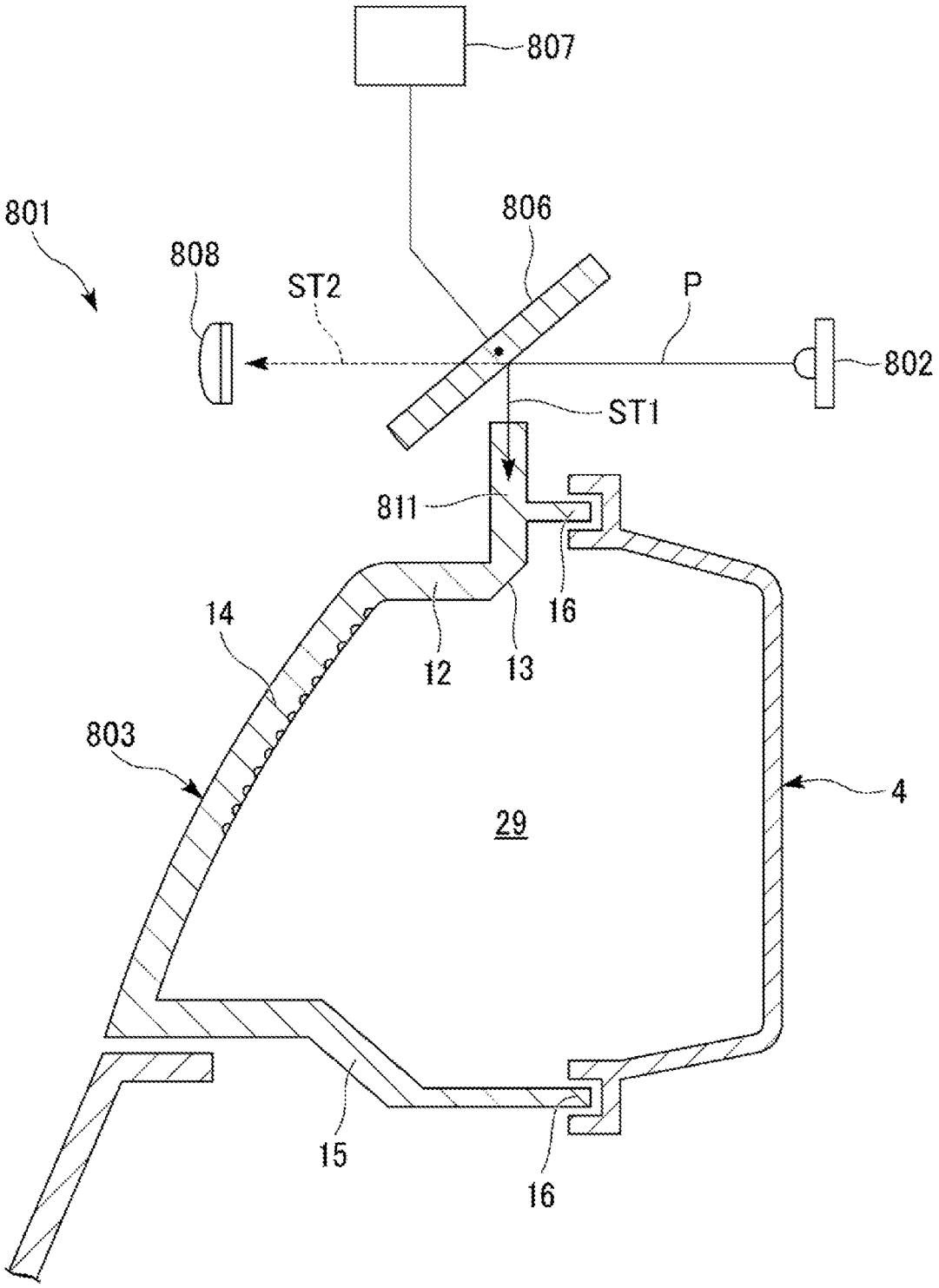
FIG. 8 is a cross-sectional view of a vehicular lamp body according to an eighth embodiment.

Next, the seventh embodiment according to the disclosure will be described. FIG. 7 is a cross-sectional view of a vehicular lamp body 701 according to the seventh embodiment. The seventh embodiment differs from the embodiments described above in that the light source 2 is disposed inside the closed cross section 29 and is connected to a light guide part 711 and the lens part 14.

In the present embodiment, the light guide part 711 is connected to the upper end part of the lens part 14 in an outer lens 703. The light guide part 711 extends toward the inside of the vehicle from the upper end part of the lens part 14. An attachment part 716 extending obliquely upward toward the inner side of the vehicle is formed on the upper surface of the light guide part 711. Thus, the vehicle inward side end part of the light guide part 711 is positioned inside the closed cross section 29. The light source 2 is disposed inside the closed cross section 29 in a manner of being adjacent to the vehicle inward side end part of the light guide part 711. Light emitted from the light source 2 passes through the light guide part 711 and is then incident on the lens part 14.

According to the present embodiment, since an optical path length from the light source 2 to the lens part 14 becomes short, efficiency of utilization of light can be enhanced. In addition, since operation effects similar to those of the sixth embodiment described above can be obtained due to the constitution in which the light guide part 711 and the lens part 14 are directly connected to each other without providing the first extension part 12, versatility of the vehicular lamp body 701 can be improved.

Eighth Embodiment

Next, the eighth embodiment according to the disclosure will be described. FIG. 4 is a cross-sectional view of a vehicular lamp body 801 according to the eighth embodiment. The eighth embodiment differs from the embodiments described above in that the vehicular lamp body 801 further includes a headlamp in addition to a daytime running lamp and a light source for a headlamp and a light source for a daytime running lamp are shared.

In the present embodiment, the vehicular lamp body 801 includes a daytime running lamp lens 803 for a daytime running lamp, a headlamp lens 808, one shared light source 802, a movable mirror 806, and a control unit 807.

Since the constitution of the daytime running lamp lens 803 is equivalent to the constitution of the outer lens 3 in the first embodiment described above, detailed description will be omitted. That is, the daytime running lamp lens 803 has the lens part 14, the reflection part 13, and the light guide part 11. The lens part 14 is exposed on the outer surface of the vehicle, guides the light P from the light source 802, and emits the light P to the outside. The reflection part 13 is integrally provided with the lens part 14, reflects the light P from the light source 802, and guides the light P to the lens part 14. The light guide part 11 guides the light from the light source 802 such that it is guided to the reflection part 13.

The headlamp lens 808 is a lens for a light different from a daytime running lamp. For example, the headlamp is a headlight. In the present embodiment, the headlamp lens 808 is disposed above the daytime running lamp lens 803. A single light source 802 is provided for the daytime running lamp and the headlamp. The light source 802 is disposed on the inner side of the vehicle than the daytime running lamp lens 803 and the headlamp lens 808. The light source 802 is disposed such that an emission direction of the light P is directed to the headlamp lens 808.

The movable mirror 806 is provided on an optical path between the light source 802 and the headlamp lens 808, and between the light source 802 and the daytime running lamp lens 803. The movable mirror 806 turns in a manner of being switchable between a first state ST1 in which the light P from the light source 802 is reflected toward the light guide part 11 of the daytime running lamp lens 803 and a second state ST2 in which the light P from the light source 802 is reflected toward the headlamp lens 808. In the first state ST1, the daytime running lamp comes on when the light P from the light source 802 is incident on the daytime running lamp lens 803. In the second state ST2, the headlamp (headlight) comes on when the light P from the light source 802 is incident on the headlamp lens 808.

The control unit 807 controls operation of the movable mirror 806. The control unit 807 switches the movable mirror 806 between the first state ST1 and the second state ST2 in accordance with the external environment of the vehicle. In the present embodiment, the control unit 807 switches the movable mirror 806 to the first state ST1 when the external environment has a brightness equal to or higher than a predetermined brightness. The control unit 807 switches the movable mirror 806 to the second state ST2 when the external environment has a brightness lower than the predetermined brightness. Accordingly, for example, the daytime running lamp comes on during the daytime, and the headlight comes on at night.

According to the present embodiment, the daytime running lamp lens 803 includes the lens part 14, the reflection part 13, and the light guide part 11. The light P from the light source 802 reaches the reflection part 13 through the light guide part 11, is reflected by the reflection part 13, and then reaches the lens part 14. Light guided to the lens part 14 is emitted to the outside from the lens part 14. In this manner, the daytime running lamp lens 803 emits light by causing the daytime running lamp lens 803 to guide the light P from the light source 802. Accordingly, since there is no need to provide an inner lens inside the daytime running lamp lens 803, compared to a technology in the related art in which an inner lens is separately provided as a light guide member inside the daytime running lamp lens 803, the number of components can be reduced. In addition, since the lens part 14 and the reflection part 13 are integrally formed, increase in the number of components can be better curbed.

Since there is no need to provide an inner lens, an extensive space on the inner side of the daytime running lamp lens 803 can be ensured. Accordingly, for example, the daytime running lamp lens 803 can be equipped with various functions by disposing other components in a space on the inner side of the daytime running lamp lens 803, or the like. In addition, since the daytime running lamp lens 803 exposed on the outer surface of the vehicle can serve as a light emission surface, compared to when an inner lens serves as the light emission surface, the size of the light emission surface can be increased. Thus, while the degree of freedom in design is improved, a light emission area larger than that of a technology in the related art can be obtained.

Moreover, the vehicular lamp body 801 includes the movable mirror 806 which is provided between the light source 802 and the daytime running lamp lens 803, the control unit 807 which controls operation of the movable mirror 806, and the headlamp lens 808. The control unit 807 switches the movable mirror 806 between the first state ST1 in which the light P from the light source 802 is reflected toward the light guide part of the daytime running lamp lens 803 and the second state ST2 in which the light P from the light source 802 is reflected toward the headlamp lens 808. In the first state ST1, the daytime running lamp comes on when the light P from the light source 802 is incident on the daytime running lamp lens 803 and the daytime running lamp lens 803 emits light. On the other hand, in the second state ST2, the headlight comes on, for example, when the light P from the light source 802 is emitted toward the headlamp lens 808. The daytime running lamp is used mainly during the daytime, and the headlight is used mainly at night. For this reason, one light source 802 can be used as both the light source 802 for a daytime running lamp and the light source 802 for a headlight by switching the movable mirror 806 in accordance with the external environment of the vehicle. Accordingly, the light source 802 can be efficiently utilized, and the number of components can be reduced compared to when the light source 802 is individually provided for each of the lights. Particularly, since a bright light source 802 for a headlight can be used, a sufficient brightness can be ensured even if the light source 802 is shared. In addition, due to a structure in which the light P from the light source 802 is guided and emitted by the daytime running lamp lens 803, compared to a technology in the related art in which an inner lens is provided as a light guide member on the inner side of the daytime running lamp lens 803, a constitution using the shared light source 802 described above can be easily realized. Thus, the degree of freedom in design and versatility can be improved.

Therefore, it is possible to provide a vehicular lamp body 801 in which the degree of freedom in design can be improved and a light emission area having a sufficient size can be ensured while the number of components is reduced.

The control unit 807 switches the movable mirror 806 to the first state ST1 when the external environment has a brightness equal to or higher than a predetermined brightness and switches the movable mirror 806 to the second state ST2 when the external environment has a brightness lower than the predetermined brightness. In this manner, the movable mirror 806 can be switched to the first state ST1 during the daytime, that is, the daytime running lamp can come on by switching the movable mirror 806 in accordance with the brightness outside the vehicle. In addition, the movable mirror 806 can be switched to the second state ST2, that is, the headlight can come on at night. Thus, the kind of a light used automatically switches in accordance with the external environment, and it is possible to achieve the vehicular lamp body 801 which is easy for a driver to use.

The technical scope of the disclosure is not limited to the embodiments described above, and various changes can be added within a range not departing from the gist of the disclosure.

For example, in the eighth embodiment described above, the control unit 807 may switch between the first state ST1 and the second state ST2 on the basis of a switching operation or the like of a driver, for example.

The first seal part 23 and the second seal part 32 may have a constitution in which sealing properties are ensured by performing coating or the like having a large coefficient of friction, for example.

In the first to seventh embodiments, for example, the vehicular lamp bodies 1, 201, 301, 401, 501, 601, and 701 may be applied to lights, such as a tail lamp, a position lamp, and a headlight, other than a daytime running lamp.

The light diffusion part 10 may be surface texturing, a diffusion film, or the like, for example, in addition to a lens cut.

Furthermore, within a range not departing from the gist of the disclosure, the constituent elements in the embodiments described above can be suitably replaced with known constituent elements. In addition, the embodiments described above may be suitably combined.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A vehicular lamp body, comprising:

a light source which is mounted in a vehicle;

an outer lens which guides light from the light source and emits the light;

a housing which holds the outer lens; and a light source cover which holds the light source, wherein the outer lens has a lens part which is exposed on an outer surface of the vehicle, guides the light from the light source, and emits the light to the outside, and a reflection part which is integrally formed with the lens part, reflects the light from the light source, and guides the light to the lens part, and wherein the housing has a first seal part which seals a space between the housing and the outer lens, and wherein the light source cover has a second seal part which seals a space between the light source cover and the outer lens, wherein a light diffusion part is formed on an inner surface of the lens part.

2. The vehicular lamp body according to claim 1, wherein a closed cross section is formed by the outer lens and the housing, and wherein the light source is disposed outside the closed cross section.

3. A vehicular lamp body, comprising:

a light source which is mounted in a vehicle;

a daytime running lamp lens for a daytime running lamp which guides light from the light source and emits the light;

a movable mirror which is provided between the light source and the daytime running lamp lens;

a control unit which controls operation of the movable mirror; and a headlamp lens which guides light from the light source to irradiate a side in front of the vehicle and is different from the daytime running lamp lens, wherein the daytime running lamp lens has a lens part which is exposed on an outer surface of the vehicle, guides light from the light source, and emits the light to the outside, a reflection part which is integrally provided with the lens part, reflects light from the light source, and guides the light to the lens part, and a light guide part which guides light from the light source and guides the light to the reflection part, and wherein the control unit switches the movable mirror in accordance with an external environment of the vehicle between a first state in which light from the light source is reflected toward the light guide part of the daytime running lamp lens and a second state in which light from the light source is reflected toward the headlamp lens.

4. The vehicular lamp body according to claim 3, wherein the control unit switches the movable mirror to the first state when the external environment has a brightness equal to or higher than a predetermined brightness and switches the movable mirror to the second state when the external environment has a brightness lower than the predetermined brightness.

* * * * *